US011590671B2

(12) United States Patent
Gereg et al.

(10) Patent No.: US 11,590,671 B2
(45) Date of Patent: Feb. 28, 2023

(54) KNIFE HOLDERS, CUTTING HEADS AND SLICING MACHINES EQUIPPED THEREWITH, AND PROCESSES OF MANUFACTURE

(71) Applicant: Urschel Laboratories, Inc., Chesterton, IN (US)

(72) Inventors: Dustin Joseph Gereg, Valparaiso, IN (US); Jeffrey S. Radinsky, Valparaiso, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 17/371,358

(22) Filed: Jul. 9, 2021

(65) Prior Publication Data

US 2022/0009118 A1 Jan. 13, 2022

Related U.S. Application Data

(60) Provisional application No. 63/049,725, filed on Jul. 9, 2020.

(51) Int. Cl.

| | |
|---|---|
| ***B26D 7/26*** | (2006.01) |
| ***B26D 1/25*** | (2006.01) |
| ***B26D 7/06*** | (2006.01) |

(52) U.S. Cl.

CPC ..... *B26D 7/2614* (2013.01); *B26D 1/25* (2013.01); *B26D 7/0691* (2013.01); *B26D 2210/02* (2013.01)

(58) Field of Classification Search

CPC ..... B26D 7/2614; B26D 1/25; B26D 7/0691; B26D 1/03; B26D 1/035; B26D 1/0006; B26D 1/006; B26D 3/26; B26D 2210/02

See application file for complete search history.

(56) References Cited

U.S. PATENT DOCUMENTS

| | | | | |
|---|---|---|---|---|
| 4,523,503 A | | 6/1985 | Julian et al. | |
| 4,590,835 A | * | 5/1986 | Matsuo | B26D 7/2614 83/858 |
| 5,095,875 A | * | 3/1992 | Morris | B26D 1/0006 83/404.3 |

(Continued)

FOREIGN PATENT DOCUMENTS

| | | |
|---|---|---|
| JP | 2016539813 | 12/2016 |

OTHER PUBLICATIONS

International Search Report & Written Opinion for International Application No. PCT/US2021/041026, dated Nov. 1, 2021, (11 pages).

*Primary Examiner* — Evan H MacFarlane

(74) *Attorney, Agent, or Firm* — Hartman Global IP Law; Gary M. Hartman; Domenica N. S. Hartman

(57) ABSTRACT

A knife holder has a base and a knife support portion extending from the base. The knife support portion includes a distal edge and a knife support surface for supporting a knife. The knife support surface includes a shaped portion and a relieved surface. The shaped portion has a wavy shape and is located adjacent the distal edge. The relieved surface does not have a wavy shape and is located on the knife support surface so that at least part of the shaped portion is between the relieved surface and the distal edge. An abutment surface is between the base and the relieved surface and is defined by the relieved surface.

22 Claims, 8 Drawing Sheets

(56) References Cited

U.S. PATENT DOCUMENTS

| | | | | |
|---|---|---|---|---|
| 5,555,787 | A * | 9/1996 | Barber | B26D 1/03 83/404.3 |
| 5,819,628 | A * | 10/1998 | Cogan | B23D 35/008 83/404.3 |
| 9,840,015 | B2 * | 12/2017 | King | B26D 1/03 |
| 2014/0290451 | A1 | 10/2014 | Jacko et al. | |
| 2016/0075047 | A1 | 3/2016 | Bucks | |
| 2016/0288353 | A1 * | 10/2016 | McCracken | B26D 7/01 |
| 2016/0288358 | A1 | 10/2016 | Bucks | |
| 2019/0210239 | A1 * | 7/2019 | Baxter | B26D 1/03 |
| 2021/0086387 | A1 * | 3/2021 | Bucks | B26D 3/28 |

* cited by examiner

KNIFE HOLDERS, CUTTING HEADS AND SLICING MACHINES EQUIPPED THEREWITH, AND PROCESSES OF MANUFACTURE

CROSS-REFERENCE TO RELATED APPLICATIONS

This application claims the benefit of U.S. Provisional Application No. 63/049,725, filed Jul. 9, 2020, the contents of which are incorporated herein by reference.

BACKGROUND OF THE INVENTION

The present invention generally relates to machines for cutting products, including but not limited to slicing machines adapted for slicing food products. The invention particularly relates to knife holders for use with centrifugal-type slicing machines.

Various types of equipment are known for slicing, shredding and granulating food products, as nonlimiting examples, vegetables, fruits, dairy products, and meat products. Widely used machines for this purpose are commercially available from Urschel Laboratories, Inc., and include machines under the name Model CC®. The Model CC® machines are centrifugal-type slicers capable of slicing a wide variety of products at high production capacities. The Model CC® line of machines is particularly adapted to produce uniform slices, strip cuts, shreds, and granulations. Certain configurations and aspects of Model CC® machines are represented in U.S. Pat. Nos. 3,139,128, 3,139,129, 5,694,824, 6,968,765, 7,658,133, 8,161,856, 9,193,086, 10,456,943, 10,562,203, 10,632,639, and 10,933,552 and U.S. Patent Application Publication No. 2019/0210239, the entire contents of which are incorporated herein by reference.

FIG. 1 schematically represents a cross-sectional view of a machine 10 that is representative of a Model CC® machine. The machine 10 includes a generally annular-shaped cutting head 12 and an impeller 14 coaxially mounted within the cutting head 12. The impeller 14 has an axis 17 of rotation that coincides with the center axis of the cutting head 12, and is rotationally driven about its axis 17 through a shaft (not shown) that is enclosed within a housing 18 and coupled to a gear box 16. The cutting head 12 is mounted on a support ring 15 above the gear box 16 and remains stationary as the impeller 14 rotates. Products are delivered to the cutting head 12 and impeller 14 through a feed hopper 11 located above the impeller 14. In operation, as the hopper 11 delivers products to the impeller 14, centrifugal forces cause the products to move outward into engagement with cutting knives (not shown) that are mounted along the circumference of the cutting head 12. The impeller 14 comprises generally radially-oriented paddles 13, each having a face that engages and directs the products radially outward toward and against the knives of the cutting head 12 as the impeller 14 rotates. Other aspects pertaining to the construction and operation of Model CC® machines, including various embodiments thereof, can be appreciated from the aforementioned prior patent documents incorporated herein by reference.

FIG. 2 is an isolated view of a particular but nonlimiting example of a cutting head 12 that has been used with Model CC® slicing machines, including the machine 10 schematically represented in FIG. 1. The cutting head 12 represented in FIG. 2 will be described hereinafter in reference to the machine 10 of FIG. 1 equipped with an impeller 14 as described in reference to FIG. 1. On the basis of the coaxial arrangement of the cutting head 12 and the impeller 14, relative terms including but not limited to "axial," "circumferential," "radial," etc., and related forms thereof may be used below to describe the cutting head 12 represented in FIG. 2.

The cutting head 12 can be seen as generally annular-shaped with cutting knives 20 mounted and circumferentially spaced apart along its perimeter. Each knife 20 projects radially inward in a direction generally opposite the direction of rotation of the impeller 14 within the cutting head 12, and the leading edge of each knife 20 defines a cutting edge at the innermost radial extremity of the knife 20. The cutting head 12 further comprises lower and upper support members, represented in FIG. 2 as rings 22 and 24, respectively, to and between which circumferentially-spaced support segments, referred to herein as shoes 26, are secured with fasteners 34.

A knife 20 can be associated with each shoe 26, in which case the shoes 26 may be referred to as cutting stations of the cutting head 12. The knives 20 of the cutting head 12 are represented in FIG. 2 as being individually secured with clamping assemblies 28 to their respective shoes 26. Each clamping assembly 28 includes a knife holder 30 mounted to a shoe 26 and between the support rings 22 and 24, and a clamp 32 positioned on the radially outward-facing side of the holder 30 to secure a knife 20 thereto. Each knife 20 is supported by a radially outer surface of one of the knife holders 30, and the corresponding clamp 32 overlies the holder 30 so that the knife 20 is between the outer surface of the holder 30 and a radially inward surface of the clamp 32 that faces the holder 30. By forcing the clamp 32 toward the holder 30, for example, with bolts 38, the clamp 32 applies a clamping force to the knife 20 adjacent its cutting edge. As an alternative to the use of bolts, an eccentric cam rod can be used as a quick-clamping feature to apply the clamping force to the clamp 32, nonlimiting examples of which include U.S. Pat. Nos. 7,658,133, 10,562,203, 10,780,602, 10,786,922, 10,807,268, and 10,933,552, the entire contents of which are incorporated herein by reference.

FIG. 2 further shows a gate 36 secured to each shoe 26. A food product crosses the gate 36 prior to encountering the knife 20 mounted to the succeeding shoe 26, and together the cutting edge of a knife 20 and a trailing edge of the preceding gate 36 define a gate opening that determines the thickness of a slice produced by the knife 20.

FIG. 2 shows the knives 20 as having straight cutting edges for producing flat slices, and as such may be referred to herein as "flat" knives, though the cutting head 12 can use knives of other shapes. As a nonlimiting example, the cutting head 12 may be configured to use "shaped" knives, including but not limited to knives characterized by a periodic pattern of alternating peaks and valleys when viewed edgewise, including but not limited to corrugated, sinusoidal, and other "wavy" shapes, to produce wavy, strip-cut, shredded, and granulated products.

While centrifugal-type slicers of the type represented by the Model CC® have performed extremely well for their intended purpose, further improvements are continuously desired and sought, including improvements relating to the maintenance of the machines. A nonlimiting example is the configuration of the knife holders 30. FIGS. 3 through 10 represent two nonlimiting examples of knife holders that have been utilized in Model CC® machines.

In FIGS. 3 through 6, a machined knife holder 40A is shown. The holder 40A includes a base 42A from which a knife support portion 44A extends. The knife support portion 44A defines a knife support surface 46A located on the radially outward facing side of the holder 40A and on which a knife 20 is supported (FIGS. 5 and 6) so that the cutting edge of the knife 20 extends beyond the distal (leading) edge of the knife support portion 44A. The knife 20 is represented as a shaped knife for producing wavy, strip-cut, shredded, or granulated products, and the knife support surface 46A is represented as having a shape that is complementary to the shaped knife 20. The knife holder 40A includes pins 48A that are received in complementary holes in the knife 20 to assist in securing and accurately positioning the knife 20 on the holder 40A, for example, in combination with a clamp (not shown). A portion of a backside 50A (radially inward facing side) of the holder 40A that may contact product during slicing is intentionally functional in that it is shaped to have a wavy shape similar to the knife 20 to inhibit product shifting during the cutting operation. Other benefits of this configuration include the ability to accurately define the knife support portion 44A and its surface 46A to accurately and fully support the knife 20 over its entire length and width and form the knife support portion 44A to be rigid to minimize deflection.

A formed (e.g., forged) knife holder 40B is shown in FIGS. 7 through 10. The holder 40B includes a base 42B from which a knife support portion 44B extends. The knife support portion 44B defines a knife support surface 46B located on the radially outward facing side of the holder 40B and on which a knife 20 (FIGS. 9 and 10) is supported so that the cutting edge of the knife 20 extends beyond the distal (leading) edge of the knife support portion 44B. The knife holder 40B lacks the pins 48A of FIGS. 3 through 6, and instead the holder 40B is formed to have an abutment wall 48B against which the back edge of the knife 20 (opposite its cutting edge) abuts to assist in securing and accurately positioning the knife 20 on the holder 40B, for example, in combination with a clamp (not shown). Only the backside 50B (radially inward facing side) of the knife support portion 44B is shaped to have a wavy shape similar to the knife 20. Benefits of this configuration include the elimination of the pins 48A of FIGS. 3 through 6 and the ability to fully and positively support the back edge of the knife 20 with the abutment wall 48B. However, the formed shape of the support portion 44B is less accurate than the machined shaped of the support portion 44A of the machined knife holder 40A of FIGS. 3 through 6.

Additionally, the support portion 44B is represented in FIGS. 7 through 10 as thinner and therefore less rigid than the support portion 44A of the machined knife holder 40A.

BRIEF DESCRIPTION OF THE INVENTION

The present invention provides knife holders for slicing machines, cutting heads and centrifugal-type slicing machines equipped therewith, and processes of machining the knife holders.

According to an aspect of the invention, a knife holder has a base and a knife support portion extending from the base. The knife support portion includes a distal edge and a knife support surface for supporting a knife. The knife support surface includes a shaped portion and a relieved surface. The shaped portion has a wavy shape and is located adjacent the distal edge. The relieved surface does not have a wavy shape and is located on the knife support surface so that at least part of the shaped portion is between the relieved surface and the distal edge. An abutment surface is between the base and the relieved surface and is defined by the relieved surface.

According to other aspects of the invention, a cutting head and a slicing machine are provided comprising a knife holder as described above. Additionally, a process of manufacturing the knife holder includes machining the shaped portion in the knife support surface, and then machining the relieved surface in the shaped portion to thereby define the abutment surface between the base and the relieved surface.

Technical effects of knife holders having features as described above include the ability to fully and positively locate and support a back edge of a knife with the abutment wall. Such knife holders also have the ability to accurately define the knife support portion and its knife support surface to accurately and fully support a knife over its entire length and lateral width, and the knife support portion can be relatively thick so as to be rigid to minimize deflection.

Other aspects and advantages of this invention will be appreciated from the following detailed description.

BRIEF DESCRIPTION OF THE DRAWINGS

FIG. 11 depicts a perspective view of the knife holder showing a radially outward surface thereof, FIG. 12 depicts a backside of the holder of FIG. 11 opposite the radially outward surface of the holder, FIG. 13 is an end view of the holder of FIG. 11, FIG. 14 is a cross-sectional view of FIG. 11 along section line A-A, FIG. 15 is a view similar to FIG. 11 but with the addition of a knife located on a support surface of the holder, FIG. 16 is a cross-sectional view of FIG. 15 along section line B-B, FIG. 17 depicts the backside of the holder of FIGS. 15 and 16 with the knife on its support surface, and FIGS. 18 and 19 are detailed views of an end portion of the holder.

DETAILED DESCRIPTION OF THE INVENTION

Figure 1:
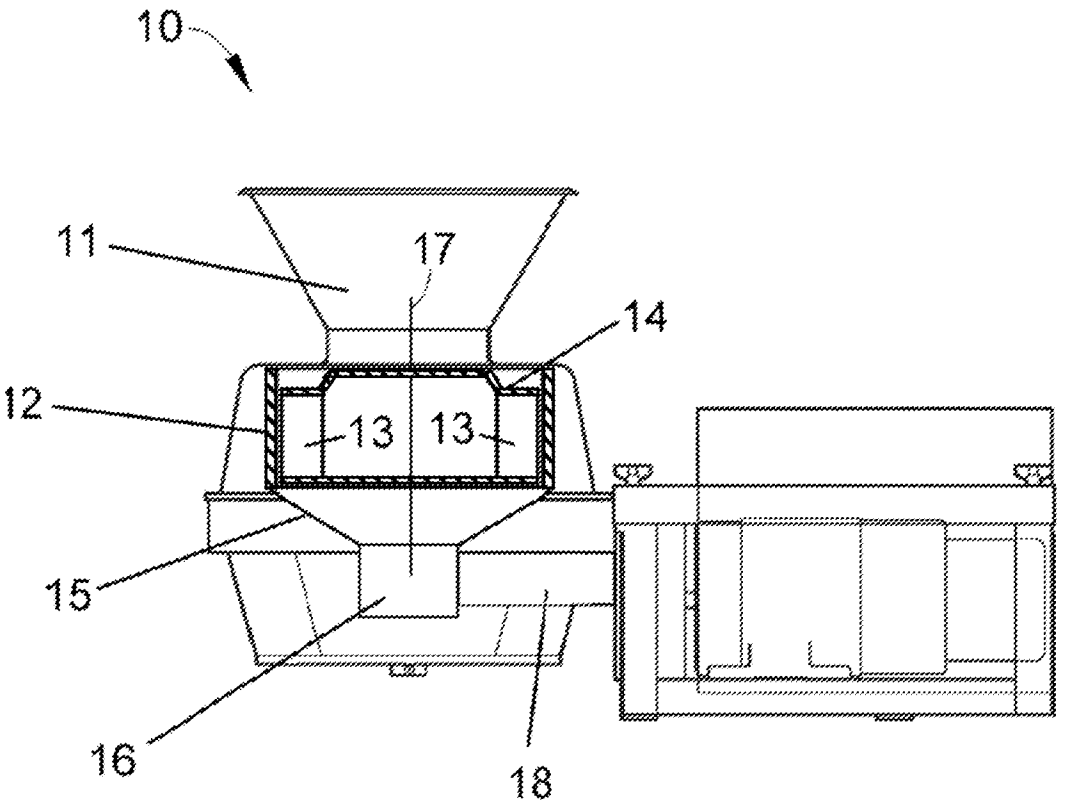
FIG. 1 Prior Art
FIG. 1 schematically represents a side view in partial cross-section of a centrifugal-type slicing machine known in the art.

The intended purpose of the following detailed description of the invention and the phraseology and terminology employed therein is to describe what is shown in the drawings, which include the depiction of one or more nonlimiting embodiments of the invention, and to describe certain but not all aspects of what is depicted in the drawings, including the embodiment(s) depicted in the drawings. The following detailed description also identifies certain but not all alternatives of the embodiment(s) depicted in the drawings. Therefore, the appended claims, and not the detailed description, are intended to particularly point out subject matter regarded as the invention, including certain but not necessarily all of the aspects and alternatives described in the detailed description.

Figure 2:
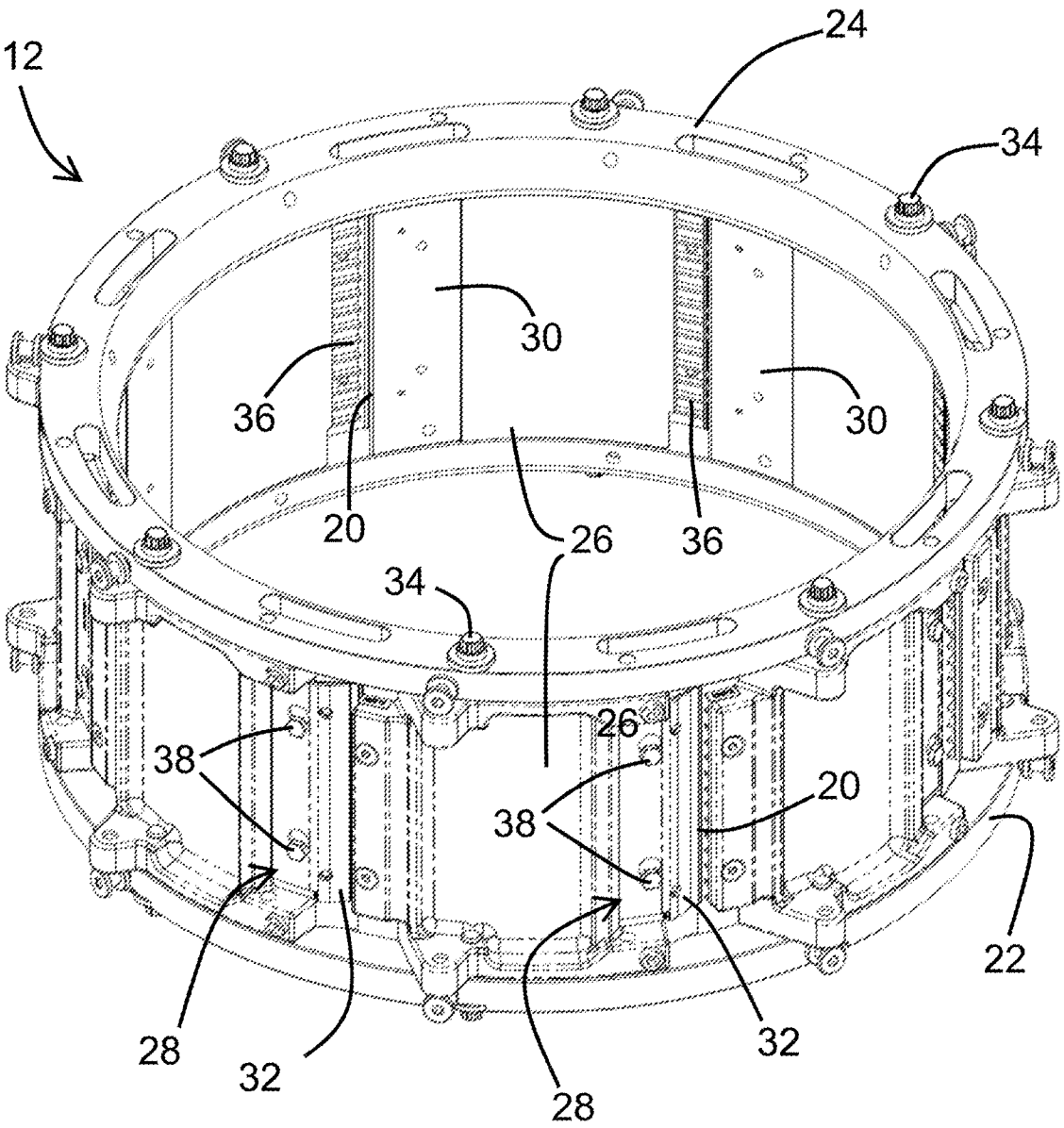
FIG. 2 Prior Art
FIG. 2 is a perspective view representing a cutting head that has found use in slicing machines of the type represented in FIG. 1.
Figure 4:
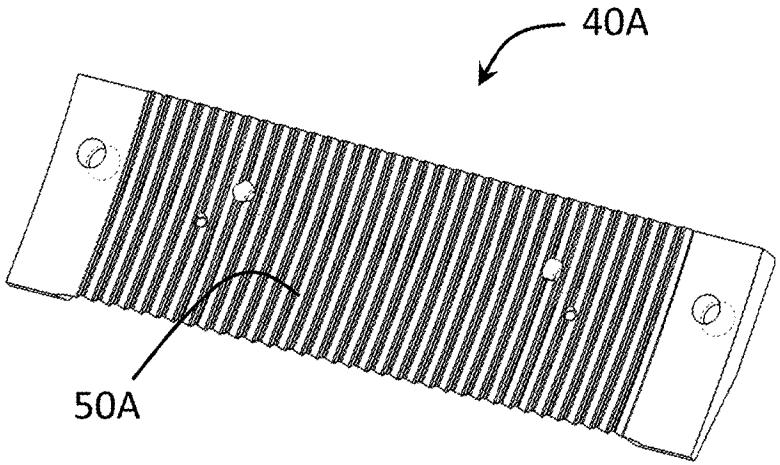
FIG. 4 PRIOR ART
FIGS. 3 through 6 represent a knife holder of a type known in the art that is suitable for use with the machine of FIG. 1 and the cutting head of FIG. 2.
Figure 6:
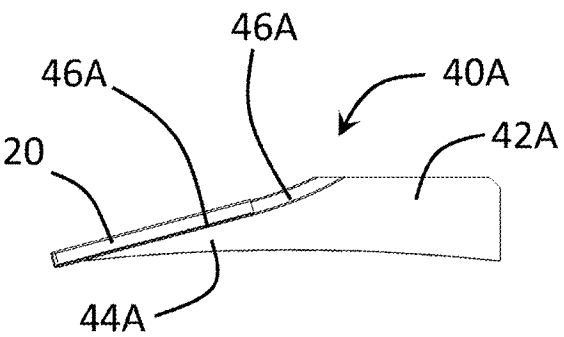
FIG. 6 PRIOR ART
Figure 3:
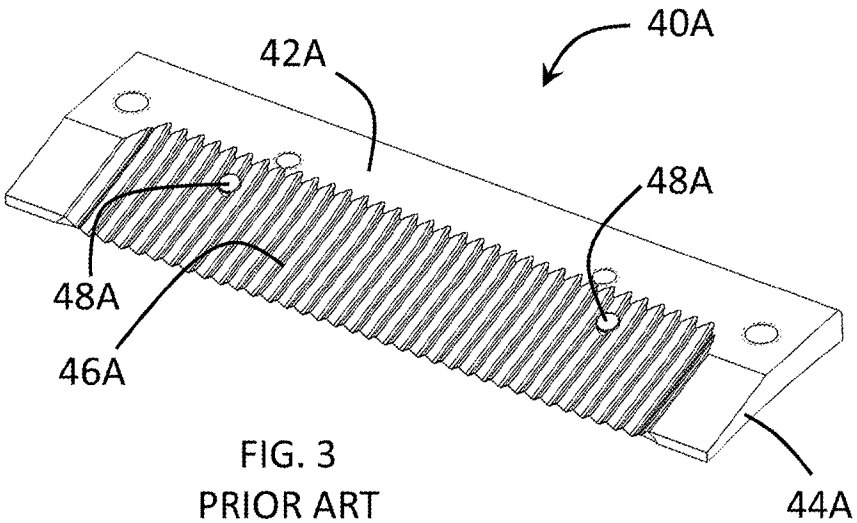
FIG. 3 PRIOR ART
Figure 5:
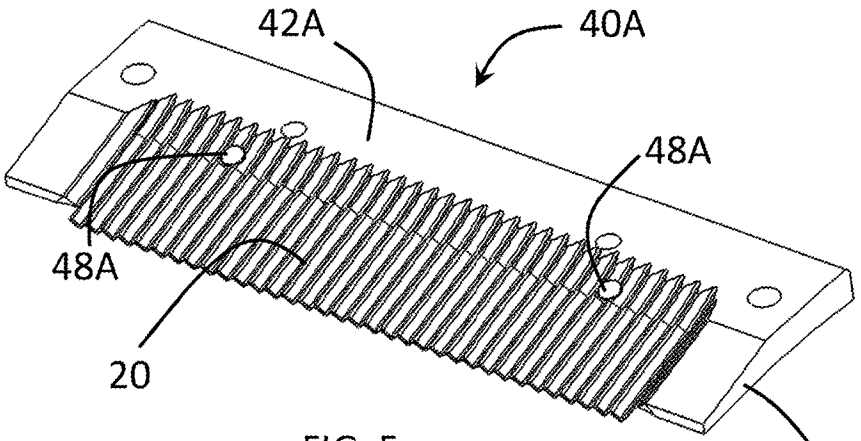
FIG. 5 PRIOR ART
Figure 7:
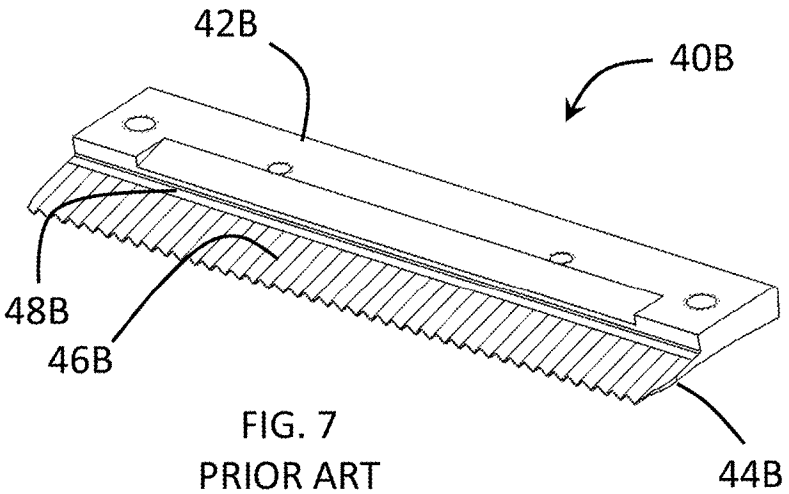
FIG. 7 PRIOR ART
FIGS. 7 through 10 represent a knife holder of another type known in the art that is suitable for use with the machine of FIG. 1 and the cutting head of FIG. 2.
Figure 8:
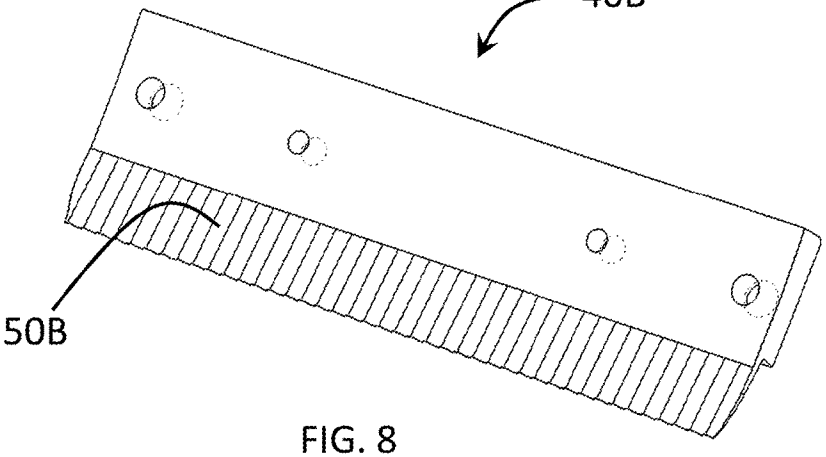
FIG. 8 PRIOR ART
Figure 9:
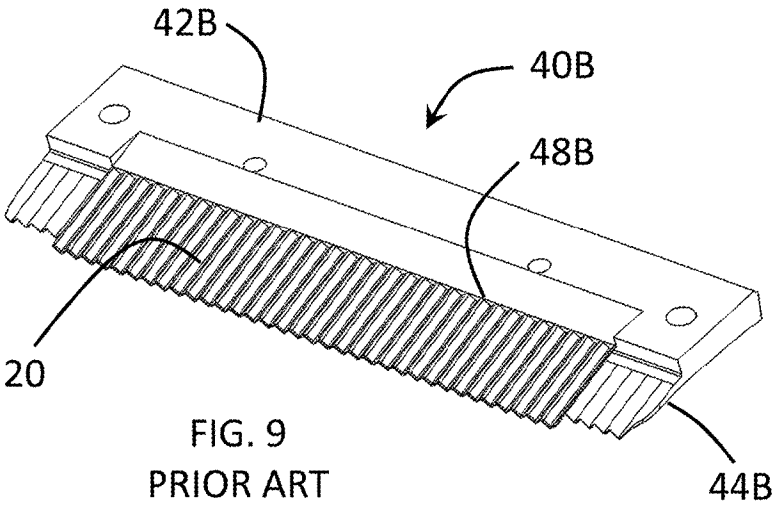
FIG. 9 PRIOR ART
Figure 10:
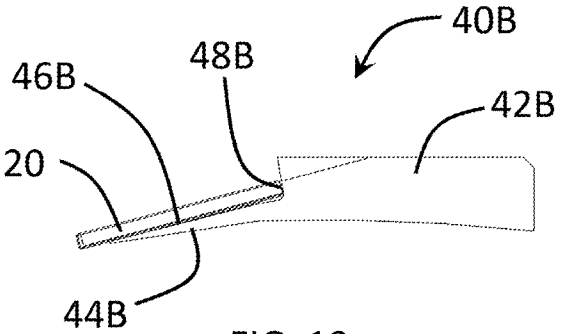
FIG. 10 PRIOR ART
Figure 12:
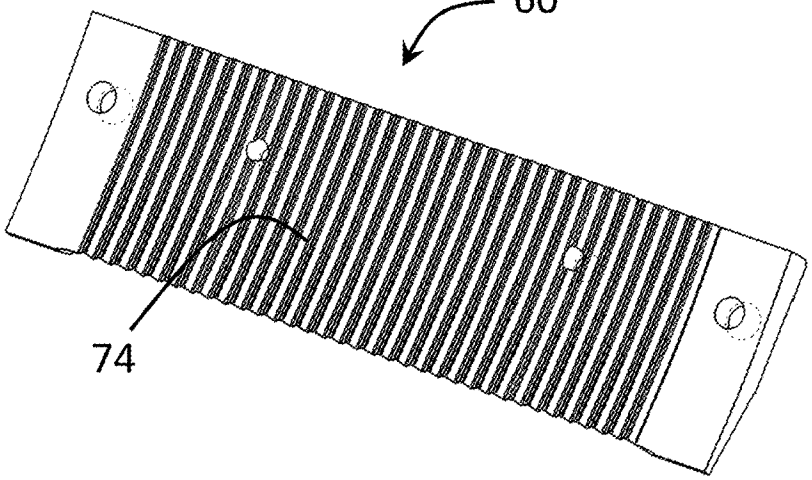
FIGS. 11 through 19 represent a knife holder suitable or adaptable for use with the machine of FIG. 1 and the cutting head of FIG. 2 in accordance with a nonlimiting embodiment of the present invention.
Figure 11:
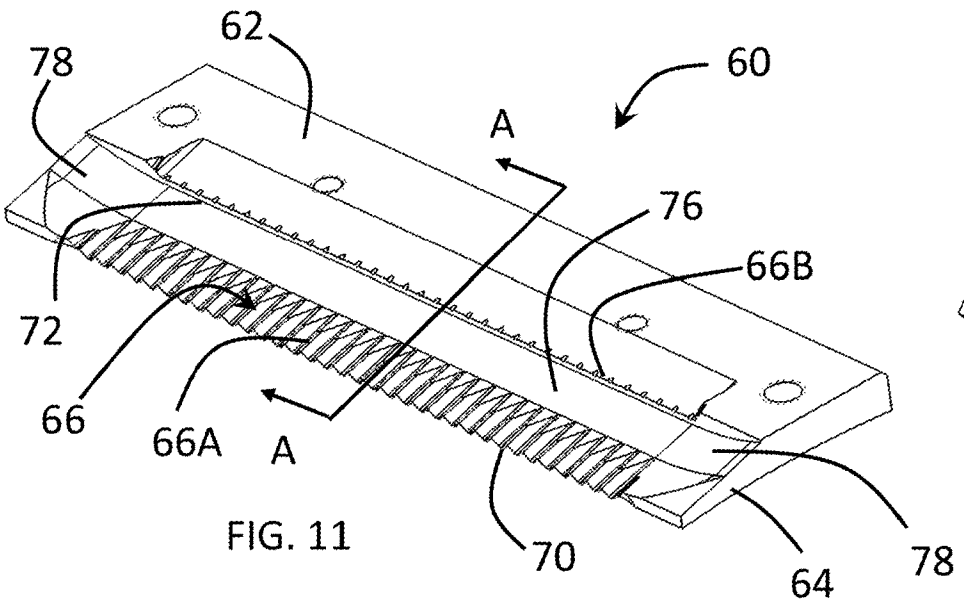

FIGS. 11 through 21 schematically represent nonlimiting embodiments of knife holders 60 that are capable of use with or at least be adaptable for installation in a variety of cutting machines, including but not limited to the centrifugal-type slicing machine 10 depicted in FIG. 1 and the cutting head 12 depicted in FIG. 2. In some instances, knife holders of the type disclosed herein may serve as replacements or modifications of knife holders for machines and cutting heads of the type represented in FIGS. 1 and 2. As a matter of convenience, the knife holders 60 will be illustrated and described hereinafter in reference to the slicing machine 10 of FIG. 1 equipped with an annular-shaped cutting head 12 as described in reference to FIG. 2. As such, the following discussion will focus primarily on certain aspects of the knife holders 60 that will be described in reference to certain aspects of the machine 10 and cutting head 12 represented in FIGS. 1 and 2, whereas other aspects of the machine 10 and cutting head 12 not discussed in any detail below may be essentially as was described in reference to FIGS. 1 and 2. However, it will be appreciated that the teachings of the invention may also be generally applicable to other types of cutting machines. Moreover, though such machines and cutting heads are particularly well suited for slicing food products, it is within the scope of the invention that knife holders of the type disclosed herein could be utilized in machines and cutting heads adapted to cut a wide variety of other types of materials.

To facilitate the description provided below of the embodiments represented in the drawings, relative terms may be used in reference to the orientation of the knife holders 60 relative to the cutting head 12 of FIG. 2, as represented by the cutting head 12 and impeller 14 of the machine 10 represented in FIG. 1. On the basis of the coaxial arrangement of the cutting head 12 and impeller 14 in FIG. 1, relative terms including but not limited to "axial," "circumferential," "radial," etc., and related forms thereof may also be used below to describe the nonlimiting embodiment represented in the drawings. Furthermore, as used herein, "leading" (and related forms thereof) refers to a position or direction on the cutting head 12 that is ahead of or precedes another in the direction of rotation of the impeller 14 when assembled with and rotating within a cutting head 12, whereas "trailing" (and related forms thereof) refers to a position or direction on the cutting head 12 that follows or succeeds another relative to the direction of rotation of the impeller 14. All such relative terms are intended to indicate the construction and relative orientations of features of the knife holders 60, and therefore are relative terms that are useful to describe the illustrated embodiments but should not be otherwise interpreted as limiting the scope of the invention.

Figure 16:
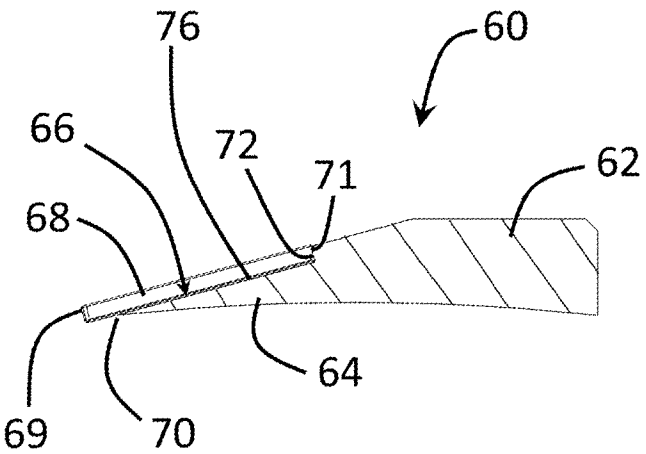
Figure 15:
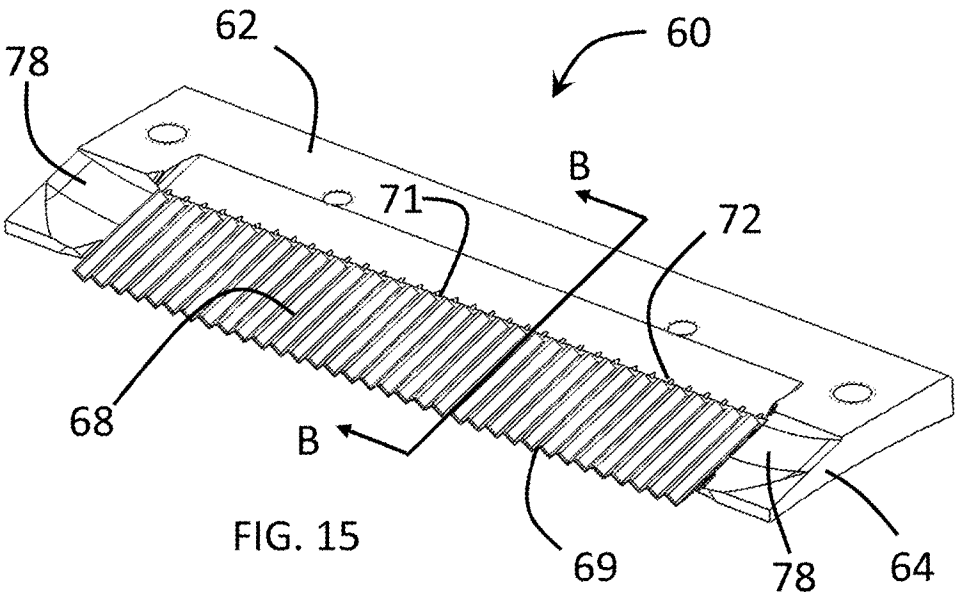
Figure 17:
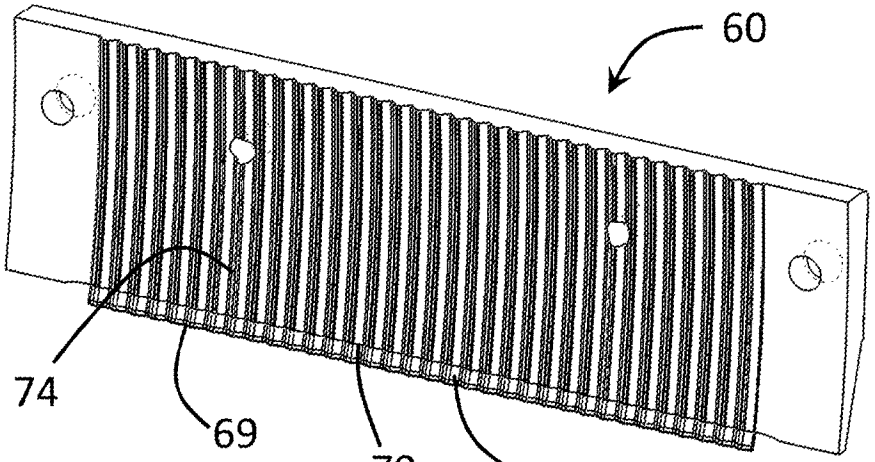

As represented in FIGS. 11 through 19, the knife holder 60 is machined and not formed, the latter of which is used herein to refer to plastic deformation processes that include forging. The holder 60 includes a base 62 from which a knife support portion 64 extends. The support portion 64 defines a knife support surface 66 located on the radially outward facing side of the holder 60 and on which a knife 68 (FIGS. 15 through 17) can be supported so that the cutting edge 69 of the knife 68 extends beyond a distal (leading) edge 70 of the support portion 64 (FIGS. 16 and 17). FIGS. 11 through 19 represent the knife holder 60 as adapted to support a shaped knife 68 (FIGS. 15 through 17) for producing wavy, strip-cut, shredded, or granulated products. As represented, the knife support surface 66 has a shaped portion 66A whose cross-sectional shape is complementary to the cross-sectional shape of the knife 68, and as such is capable of accurately and fully supporting the knife 68 over its entire length and lateral width (that is, if the knife support surface 66 is of sufficient size to accommodate the entire length and lateral width of the knife 68). Due to the presence of the shaped portion 66A, the knife support surface 66 as well as the knife holder 60 as a whole may at times be referred to as "shaped." The cross-sectional shape of the shaped portion 66A may be referred to herein as a "wavy shape," which means a periodic or nonperiodic pattern of alternating peaks and valleys when viewed edgewise.

The holder 60 is adapted to secure the knife 68 to the cutting head 12 so that the knife 68 projects radially inward in a direction generally opposite the direction of rotation of the impeller 14, and its cutting edge 69 is at its radially innermost extremity. The knife 68 and its knife holder 60 are members of a slicing unit that can be mounted to the cutting head 12 to define a cutting station. Consistent with the cutting head 12 of FIG. 2, the knife 68 can be secured to the knife holder 60 by a clamp (not shown) of any suitable design, as nonlimiting examples, a clamp secured to or engageable with the radially outward side of the holder 60 with fasteners or with a cam-actuated mechanism. As a result of being forcing toward the holder 60, such a clamp applies a clamping force to the knife 68 adjacent its cutting edge 69 to clamp the knife 68 onto the knife support surface 66 of the knife holder 60.

The knife holder 60 lacks the pins 48A of FIGS. 3 through 6, and instead the holder 60 is machined to have an abutment surface 72 against which the back (trailing) edge 71 of the knife 68 (opposite its cutting edge 69) abuts to assist in securing and accurately positioning the knife 68 on the holder 60 in combination with a clamp. The abutment surface 72 is defined by a relieved (recessed) surface 76 adjacent the base 62 of the holder 60 as a result of the abutment surface 72 being generally located where the knife support surface 66 and the base 62 adjoin each other. A portion of a backside 74 (radially inward facing side) of the holder 60 that may contact product during slicing is intentionally functional in that it is shaped similar to the knife 68 to inhibit product shifting during the cutting operation. The knife holder 60 shares certain benefits of the knife holders 40A and 40B described in reference to FIGS. 3 through 10. For example, the knife holder 60 is machined instead of formed as is the knife holder 40A of FIGS. 3 through 6, but lacks the pins 48A of FIGS. 3 through 6 and instead fully and positively locates and supports the back edge 71 of the knife 68 with its abutment wall 72. The knife holder 60 also has the ability to accurately define the knife support portion 64 and its knife support surface 66 and distal edge 70 to accurately and fully support the knife 68 over its entire length and lateral width, and the knife support portion 64 is relatively thick so as to be rigid to minimize deflection.

The abutment surface 72 is represented in FIGS. 11 through 19 as created by machining the shaped portion 66A of the knife support surface 66 and then subsequently machining the relieved surface 76 within the shaped portion 66A so that the shaped portion 66A is between and separates the relieved surface 76 and the distal edge 70 of the knife support surface 66. Due to the particular manner in which the relieved surface 76 was machined into the shaped portion 66A of the knife support surface 66, the relieved surface 76 is also depicted as between and separating the shaped portion 66A and a residual shaped portion 66B of the knife support surface 66 remote from the distal edge 70. However, it is foreseeable that the residual shaped portion 66B can be omitted.

Figure 14:
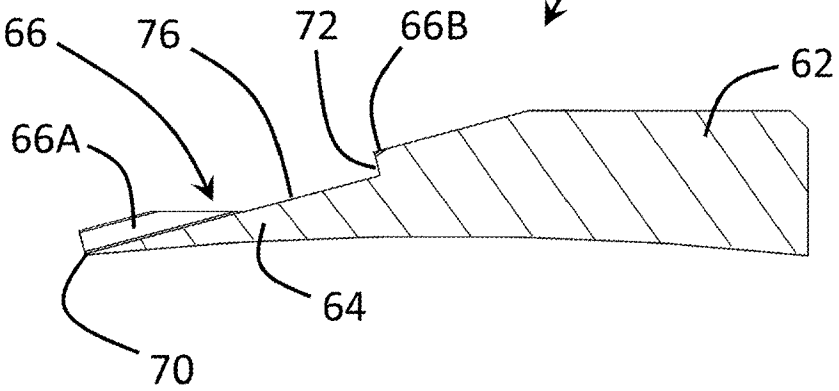

In the nonlimiting embodiment shown, the relieved surface 76 is substantially planar at least within the portion of the relieved surface 76 immediately between the base 62 and the shaped portion 66A of the knife support surface 66. As best seen in FIG. 14, which is a cross-sectional view of the holder 60 without the knife 68 and taken midlength of the holder 60 along section line A-A of FIG. 11, the relieved surface 76 is tangent with the valleys of the shaped portion 66A of the knife support surface 66 to promote knife support along the entire length and lateral width of the knife 68 as shown in FIG. 16, which represents a cross-sectional view along section line B-B of FIG. 15.

Figure 13:
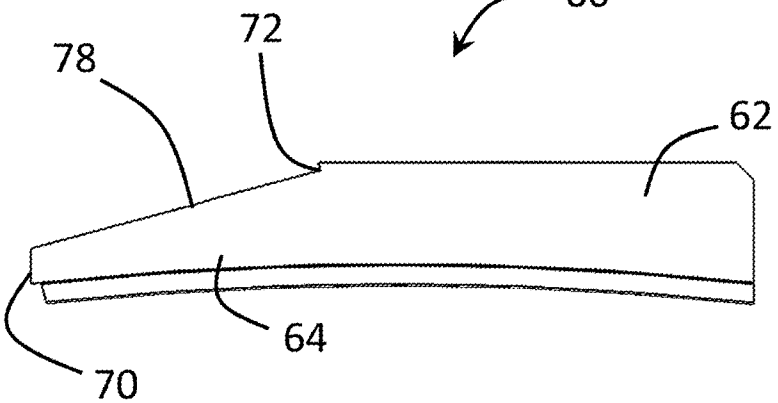

As evident from FIGS. 11, 13, 15, 18, and 19, the presence of the relieved surface 76 and its benefits are provided for while maintaining a thickness of the holder 60 at its longitudinal ends that will provide rigid support for the knife 68 and minimize deflection at the distal edge 70 of the knife holder 60. The term "longitudinal end(s)" refers to the oppositely-disposed ends of the knife holder 60 visible from a longitudinal end view, one of which is depicted in FIG. 13. Each of FIGS. 11, 13, 15, 18, and 19 depicts a longitudinal end portion 78 of the holder 60 as having been machined to have a surface 80 (FIGS. 18 and 19) that slopes from the maximum thickness of the longitudinal end portion 78 at the longitudinal ends of the holder 60 to each of the shaped portion 66A and relieved surface 76 of the knife support surface 66. As a result, the longitudinal end portions 78 of the knife support portion 64 are thicker than portions of the knife support portion 64 therebetween, as seen by a comparison of FIGS. 13 and 14. Stated another way, if one were to scan the knife holder 60 in a longitudinal direction thereof, the maximum thickness of each end portion 78 of the knife support portion 64 is greater than the maximum thickness within regions of the knife support portion 64 that are between the longitudinal end portions 78 and contain the shaped portion 66A and relieved surface 76.

Figure 19:
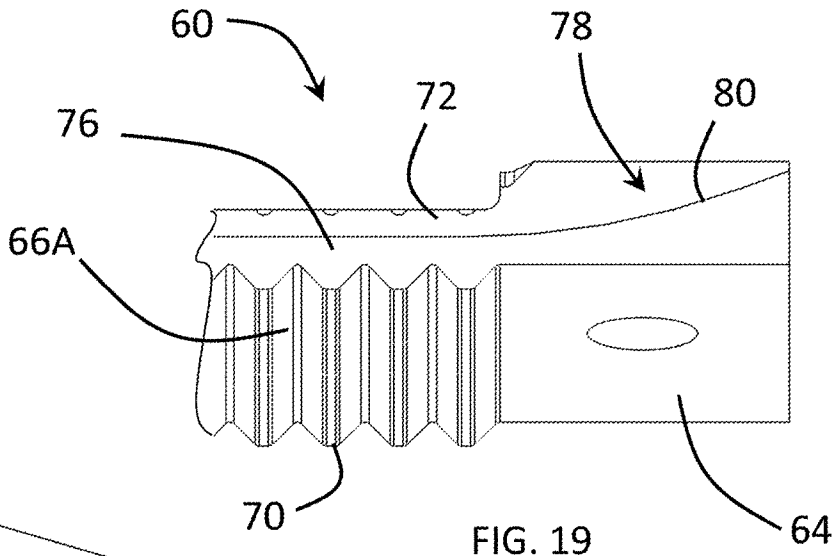
Figure 18:
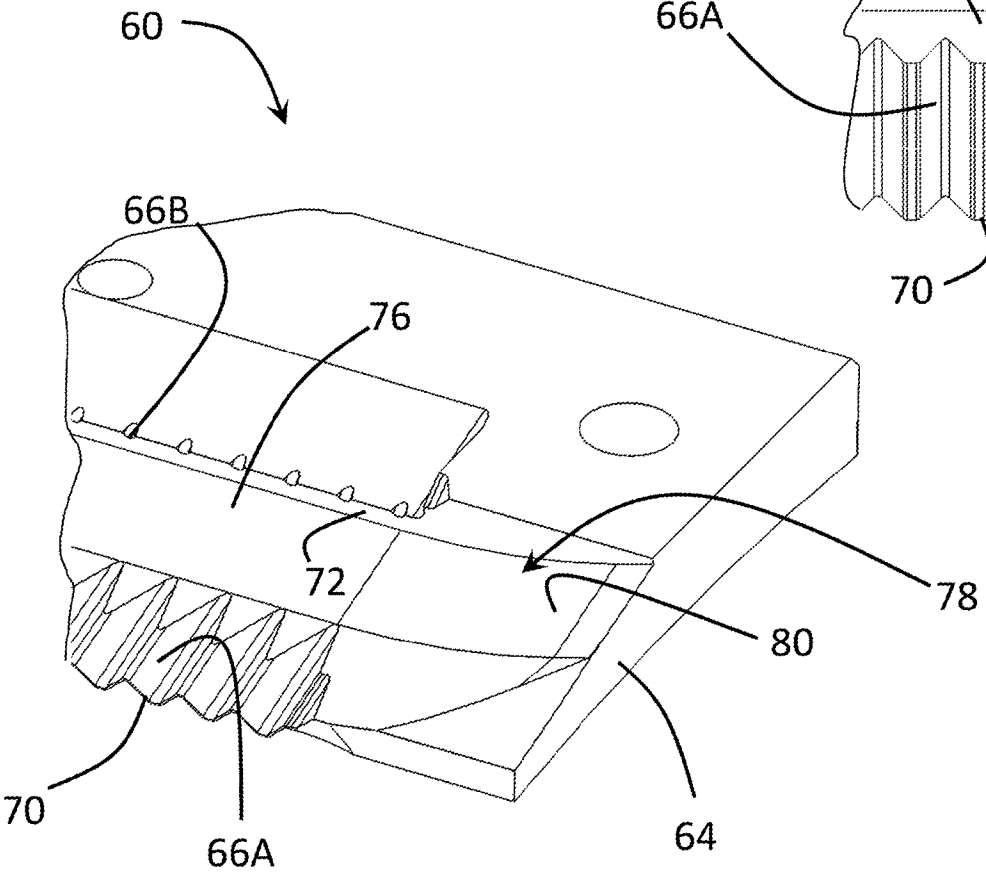

In the particular embodiment of FIGS. 11 through 19 and as particularly evident in FIG. 19, the slope of the surface 80 machined into each longitudinal end portion 78 of the holder 60 is arcuate and concave, though it is foreseeable that the surface 80 could be machined to have a linear or convex slope. The arcuate geometry of the surface 80 shown in the drawings can be obtained with a machining process that is able to avoid material removal at the extreme longitudinal ends of the holder 60 and reduces material removal adjacent the longitudinal ends to promote the rigidity of the holder 60 while allowing for a smoother transition between the longitudinal ends and each of the shaped portion 66A and relieved surface 76 to promote cleanability. The thickness of the holder 60 at midlength is also represented as greater than the thickness of the holder 30B of FIGS. 7 through 10 and comparable to that of the holder 30A of FIGS. 3 through 6.

Figure 20:
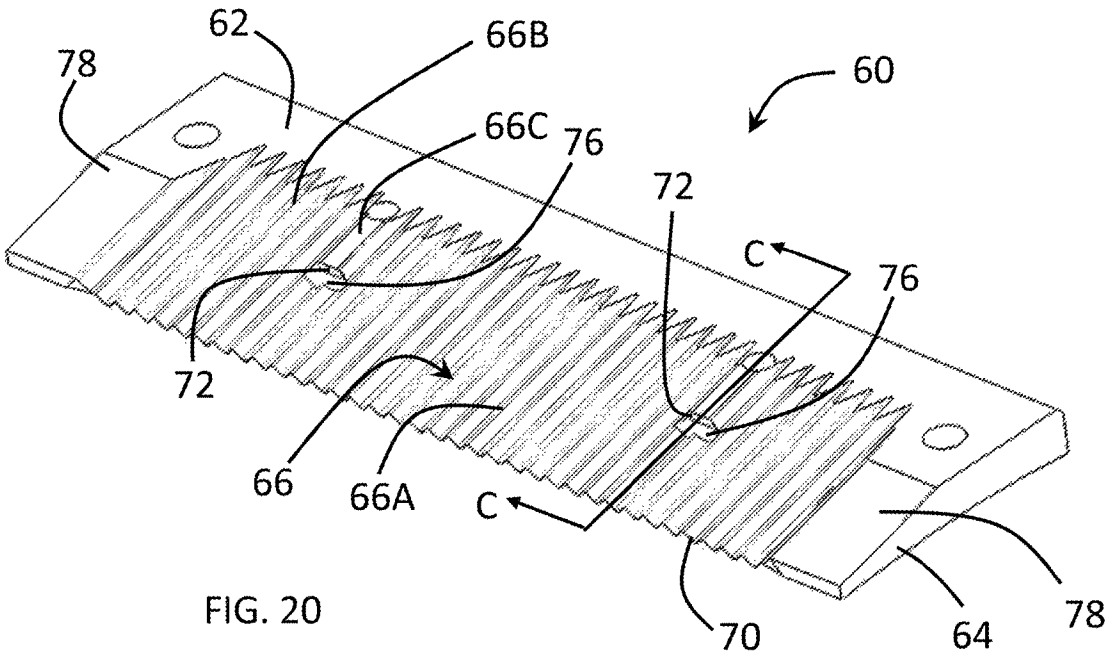
FIG. 20 represents a perspective view of a knife holder suitable or adaptable for use with the machine of FIG. 1 and the cutting head of FIG. 2 in accordance with another nonlimiting embodiment of the present invention.
Figure 21:
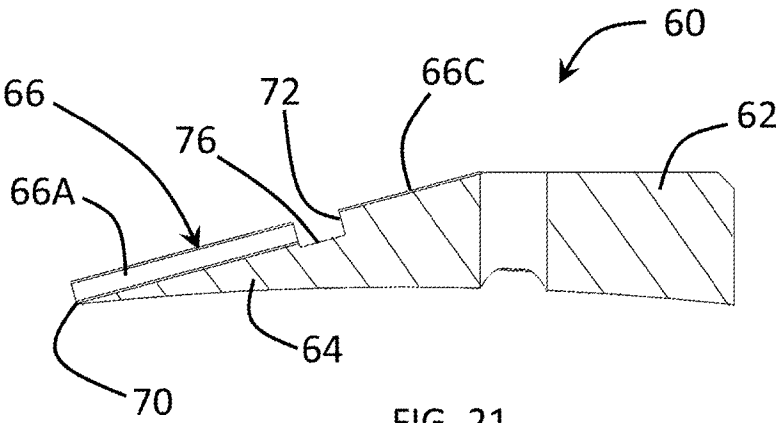
FIG. 21 is a cross-sectional view of FIG. 20 along section line C-C.

FIGS. 20 and 21 depict an additional configuration for a knife holder in accordance with a further nonlimiting embodiment of this invention. For convenience, identical reference numerals are used in FIGS. 20 and 21 to denote the same or functionally related/equivalent elements described for the knife holder 60 of FIGS. 11 through 19. In view of similarities between the embodiments, the following discussion of FIGS. 20 and 21 will focus primarily on aspects of the portrayed knife holder 60 that differ from the knife holder 60 of FIGS. 11 through 19 in some notable or significant manner. Other aspects of the knife holder 60 of FIGS. 20 and 21 that are not discussed in any detail can be, in terms of structure, function, materials, etc., essentially as was described for the knife holder 60 of FIGS. 11 through 19.

In FIGS. 20 and 21, relieved surfaces 76 are represented as multiple discrete and separate regions within the knife support surface 66. Whereas the relieved surface 76 of the knife holder 60 of FIGS. 11 through 19 is located on the knife support surface 66 so that the shaped portion 66A is entirely between the relieved surface 76 and the distal edge 70, the relieved surfaces 76 are shown in FIGS. 20 and 21 as sized and located on the knife support surface 66 so that each relieved surface 76 is bordered on at least three sides (and optionally surrounded) by the shaped portion 66A, such that part of the shaped portion 66A is between each relieved surface 76 and the distal edge 70 of the knife holder 60 and another part 66C of the shaped portion 66A is between each relieved surface 76 and the base 62 of the knife holder 60. Additionally, part of the shaped portion 66A are between each relieved surface 76 and its adjacent longitudinal end portion 78 at the longitudinal end of the knife holder 60. As with the knife holder 60 of FIGS. 11 through 19, each relieved surface 76 defines an abutment surface 72 against which the back (trailing) edge 71 of a knife 68 abuts to assist in securing and accurately positioning the knife 68 on the holder 60 in combination with a clamp. Because parts of the shaped portion 66A are between each relieved surface 76 and its adjacent longitudinal end of the knife holder 60, the sloping surfaces 80 machined in the longitudinal end portions 78 of the knife holder 60 of FIGS. 11 through 19 to adjoin the relieved surface 76 with the longitudinal ends of the knife holder 60 can be eliminated, as is evident from FIGS. 20 and 21.

While the invention has been described in terms of a specific or particular embodiment, it should be apparent that alternatives could be adopted by one skilled in the art. For example, the machine 10, cutting head 12, impeller 14, and knife holder 60 and their respective features and components could differ in appearance and construction from the embodiment described herein and shown in the drawings, functions of certain components could be performed by components of different construction but capable of a similar (though not necessarily equivalent) function, and various materials could be used in the fabrication of the machine 10, cutting head 12, impeller 14, knife holder 60, and their respective components. As such, it should be understood that the above detailed description is intended to describe the particular embodiment represented in the drawings and certain but not necessarily all features and aspects thereof, and to identify certain but not necessarily all alternatives to the represented embodiment and its described features and aspects. As a nonlimiting example, the invention encompasses additional or alternative embodiments in which one or more features or aspects of the disclosed embodiment could be eliminated. Accordingly, it should be understood that the invention is not necessarily limited to any embodiment described herein or illustrated in the drawings, and the phraseology and terminology employed above are for the purpose of describing the illustrated embodiment and do not necessarily serve as limitations to the scope of the invention. Therefore, the scope of the invention is to be limited only by the claims.

The invention claimed is:

1. A knife holder having a base and a knife support portion extending from the base, the knife support portion comprising:

a distal edge;

a knife support surface for supporting a knife, the knife support surface having a first shaped portion located adjacent the distal edge, a second shaped portion located adjacent the base, and at least a first relieved surface machined between and separating the first and second shaped portions, the first shaped portion and the second shaped portion each having a wavy shape, the first relieved surface not having a wavy shape and being located on the knife support surface so that the first shaped portion is between and separates the first relieved surface and the distal edge, the first shaped portion and the second shaped portion each having a cross-sectional shape defined by a pattern of alternating peaks and valleys, the first relieved surface being recessed into the knife support portion in a direction normal to the knife support surface so as to be recessed into the knife support surface relative to the peaks of the first and second shaped portions; and at least a first abutment surface between the second shaped portion and the first relieved surface and defined by the first relieved surface.

2. The knife holder of claim 1, wherein the first relieved surface is planar between and entirely separates the first and second shaped portions.

3. The knife holder of claim 1, further comprising a second relieved surface machined between the first and second shaped portions, the second relieved surface defining a second abutment surface between the second shaped portion and the second relieved surface, the first and second relieved surfaces being discrete and separate regions within the knife support surface.

4. The knife holder of claim 1, wherein the knife holder has longitudinal end portions at longitudinal ends of the knife holder, the longitudinal end portions being thicker than portions of the knife support portion between the longitudinal end portions.

5. The knife holder of claim 4, wherein the longitudinal end portions each have a maximum thickness that is greater than a maximum thickness within regions of the knife support portion that are between the longitudinal end portions, wherein the regions of the knife support portion contain the first shaped portion, the second shaped portion, and the first relieved surface.

6. The knife holder of claim 4, wherein each of the longitudinal end portions has a surface that slopes from a maximum thickness at the longitudinal end of the knife holder to each of the first shaped portion of the knife support surface and the first relieved surface.

7. The knife holder of claim 6, wherein the surface of each of the longitudinal end portions is arcuate.

8. The knife holder of claim 6, wherein the surface of each of the longitudinal end portions is concave.

9. The knife holder of claim 1, wherein the first relieved surface is tangential with the valleys of the first shaped portion of the knife support surface.

10. The knife holder of claim 1, wherein the knife holder has a shaped backside opposite the knife support surface.

11. The knife holder of claim 1, wherein the first shaped portion is contiguous with the distal edge of the knife support portion.

12. The knife holder of claim 1, wherein the first shaped portion is contiguous with the first relieved surface of the knife support portion.

13. The knife holder of claim 1, wherein the pattern of the alternating peaks and valleys of the first and second shaped portions comprises a periodic pattern of the alternating peaks and valleys.

14. The knife holder of claim 1, wherein the first relieved surface is located on the knife support surface so that the first shaped portion is entirely between the first relieved surface and the distal edge.

15. The knife holder of claim 1, wherein the first relieved surface is sized and located on the knife support surface so that part of the first shaped portion is between the first relieved surface and a longitudinal end portion at a longitudinal end of the knife holder.

16. A clamping assembly comprising the knife holder of claim 1, the clamping assembly comprising a knife secured to the knife support surface of the knife holder, the knife having a back edge that abuts the first abutment surface of the knife holder.

17. The clamping assembly of claim 16, wherein the knife has a wavy shape.

18. The clamping assembly of claim 17, wherein the wavy shape of the knife comprises a periodic pattern of alternating peaks and valleys.

19. A cutting head comprising the clamping assembly of claim 16 mounted thereto.

20. A slicing machine comprising the cutting head of claim 19 mounted thereto.

21. The slicing machine of claim 20, wherein the slicing machine is a centrifugal slicing machine, the cutting head is an annular-shaped cutting head, and the slicing machine further comprises an impeller assembled with the cutting head for rotation within the cutting head.

22. A process of manufacturing the knife holder of claim 1, the process comprising:

machining the pattern of alternating peaks and valleys in the knife support surface; and then machining the first relieved surface in the pattern of alternating peaks and valleys to thereby define the first shaped portion, the second shaped portion, and the first abutment surface between the second shaped portion and the first relieved surface.

* * * * *